United States Patent [19]

Minamitaka et al.

[11] Patent Number: 4,699,037

[45] Date of Patent: Oct. 13, 1987

[54] ELECTRONIC MUSICAL INSTRUMENT WITH GLIDE FUNCTION

[75] Inventors: Junichi Minamitaka; Tsunehisa Nogimura, both of Tokyo, Japan

[73] Assignee: Casio Computer Co., Ltd., Tokyo, Japan

[21] Appl. No.: 799,124

[22] Filed: Nov. 18, 1985

[30] Foreign Application Priority Data

Nov. 27, 1984 [JP] Japan ..... 59-250119

[51] Int. Cl.[4] ..... G10H 1/053; G10H 7/00

[52] U.S. Cl. ..... 84/1.1; 84/1.24; 84/DIG. 7

[58] Field of Search ..... 84/1.1, 1.24, DIG. 7

[56] References Cited

U.S. PATENT DOCUMENTS

| | | | |
|---|---|---|---|
| 4,082,028 | 4/1978 | Deutsch | 84/1.24 |
| 4,122,743 | 10/1978 | Tomisawa et al. | 84/1.24 |
| 4,198,892 | 4/1980 | Gross | 84/1.24 X |
| 4,237,764 | 12/1980 | Suzuki | 84/1.24 |
| 4,347,772 | 9/1982 | Nishimoto | 84/1.24 X |
| 4,416,178 | 11/1983 | Ishida . | |
| 4,463,647 | 8/1984 | Luce | 84/1.24 X |
| 4,503,745 | 3/1985 | Clark, Jr. et al. | 84/1.1 |
| 4,520,706 | 6/1985 | Deforeit | 84/1.1 |
| 4,539,884 | 9/1985 | Aoki | 84/1.24 |

FOREIGN PATENT DOCUMENTS

| | | |
|---|---|---|
| 1497785 | 6/1969 | Fed. Rep. of Germany . |
| 2641452 | 3/1977 | Fed. Rep. of Germany . |
| 1100572 | 5/1966 | United Kingdom . |
| 1504328 | 3/1978 | United Kingdom . |

*Primary Examiner*—S. J. Witkowski

*Attorney, Agent, or Firm*—Frishauf, Holtz, Goodman & Woodward

[57] ABSTRACT

An electronic musical instrument has a keyboard, a key depression speed detector and a glide pattern generator. When any key of the keyboard is depressed, the key depression speed detector detects the speed of depressing the key and produces a signal representing this speed. In accordance with this signal the glide pattern generator changes a reference glide pattern to a new pattern. The instrument generates a musical tone having the glide effect determined by the new glide pattern.

6 Claims, 9 Drawing Figures

FIG. 5
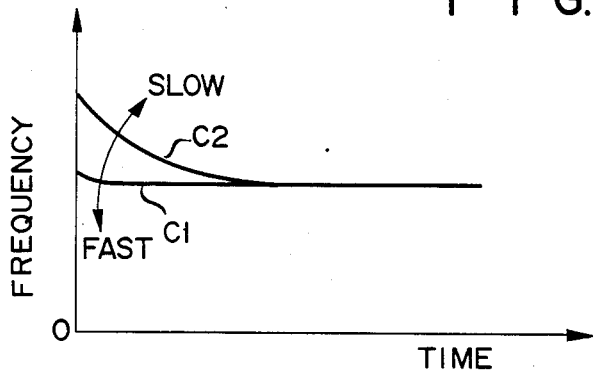
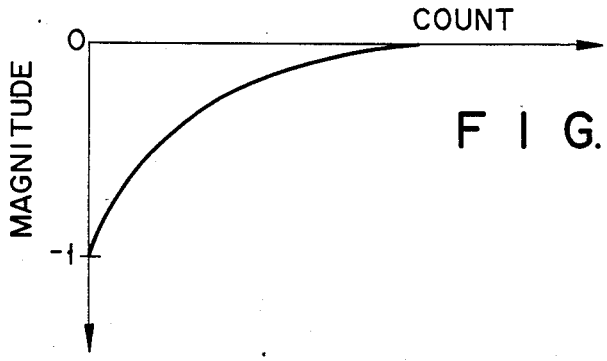
FIG. 6
FIG. 7
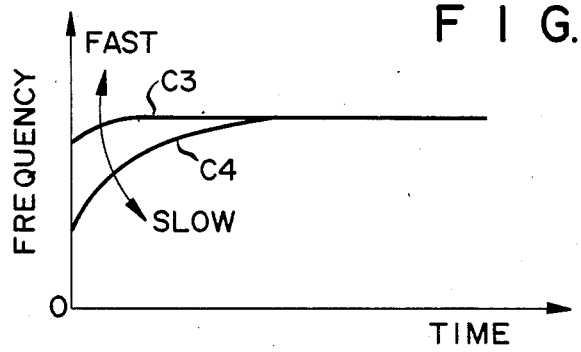

ELECTRONIC MUSICAL INSTRUMENT WITH GLIDE FUNCTION

BACKGROUND OF THE INVENTION

This invention relates to an electronic musical instrument with a keyboard and, more particularly, to an electronic musical instrument which can provide musical tones with glide effect.

A tone generated by an electronic musical instrument and having a glide effect, sounds like a tone generated by a brass instrument. The pitch of any musical tone produced by brass instruments gradually and slightly falls or rises to the proper pitch of the tone. How fast and in which direction the pitch changes depends on the manner in which the player plays the instrument, and also on the pitch of the preceding or succeeding tone.

Musical tones with a glide effect are generated by the conventional electronic musical instrument with a keyboard in the following manner. First, the player turns on a switch, whereby the instrument becomes able to produce tones with glide effect. When the player depresses any key of the keyboard, a tone signal is generated. The frequency of this signal gradually falls or rises to the frequency corresponding to the proper pitch of the musical tone to which the key is assigned. A loudspeaker converts this signal into a musical tone which sounds like one generated by brass instruments.

In the case of the conventional electronic musical instrument, the glide period, which elapses until the frequency of a tone signal falls or rises to the value corresponding to the proper pitch of the musical tone, is constant. Also constant is the difference between the initial frequency of the signal and the frequency corresponding to the proper pitch of the tone. Neither the glide period nor the frequency difference for every tone with glide effect is changed, no matter how quickly and how strongly the player depresses the key. Consequently, the musical instrument cannot generate musical tones with a delicate glide effect, and the player cannot make a sophisticated musical expression when he or she plays this instrument.

SUMMARY OF THE INVENTION

An object of the invention is to provide an electronic musical instrument, in which the glide period and/or the frequency difference are variable according to the key depression speed and/or key depression force, i.e., the key operation so that sufficiently rich musical expression can be produced.

The first feature of the electronic musical instrument according to the invention resides in that it has a keyboard with keys each having a touch response function. The touch response function entails detecting data concerning the speed and/or force with which a key is operated in response to the key operation (for the purpose of the control of the generated tone, for instance). The present electronic musical instrument has a glide pattern generator. The glide pattern generator is controlled according to the key operation data, that is, the glide pattern data provided from the glide pattern generator is controlled according to the key operation data. Through this control, the glide effect of the tone generated from the electronic musical instrument is varied according to the manner of key operation.

The second feature of the electronic musical instrument according to the invention resides in that it has a glide pattern generator, which can select data of a glide pattern from among data of a plurality of different glide patterns. The glide pattern generator is controlled according to the key operation data. The glide pattern data selectively provided from the glide pattern generator is altered according to the key operation data. Through this alteration, the glide effect of the tone generated from the electronic musical instrument is varied according to the manner of the key operation.

With the electronic musical instrument according to the invention, the glide time and/or glide width can be suitably changed according to the manner of key operation. Thus, it is possible to produce almost natural musical sounds corresponding to various kinds of musical instruments such as the violin, and particularly brass instruments such as the trumpet, with rich feeling.

Further, it is possible to permit selection of one of a plurality of different glide patterns. Thus, an optimum glide effect for each timbre can be provided.

BRIEF DESCRIPTION OF THE DRAWINGS

FIGS. 3 and 6 are graphs showing different examples of glide pattern data provided from a glide pattern memory 8 in the embodiment of FIG. 1;

FIGS. 5, 7 and 9 are graphs showing the change of tone frequency with the key depression speed in the embodiment of FIG. 1.

DETAILED DESCRIPTION OF THE PREFERRED EMBODIMENTS

Figure 1:
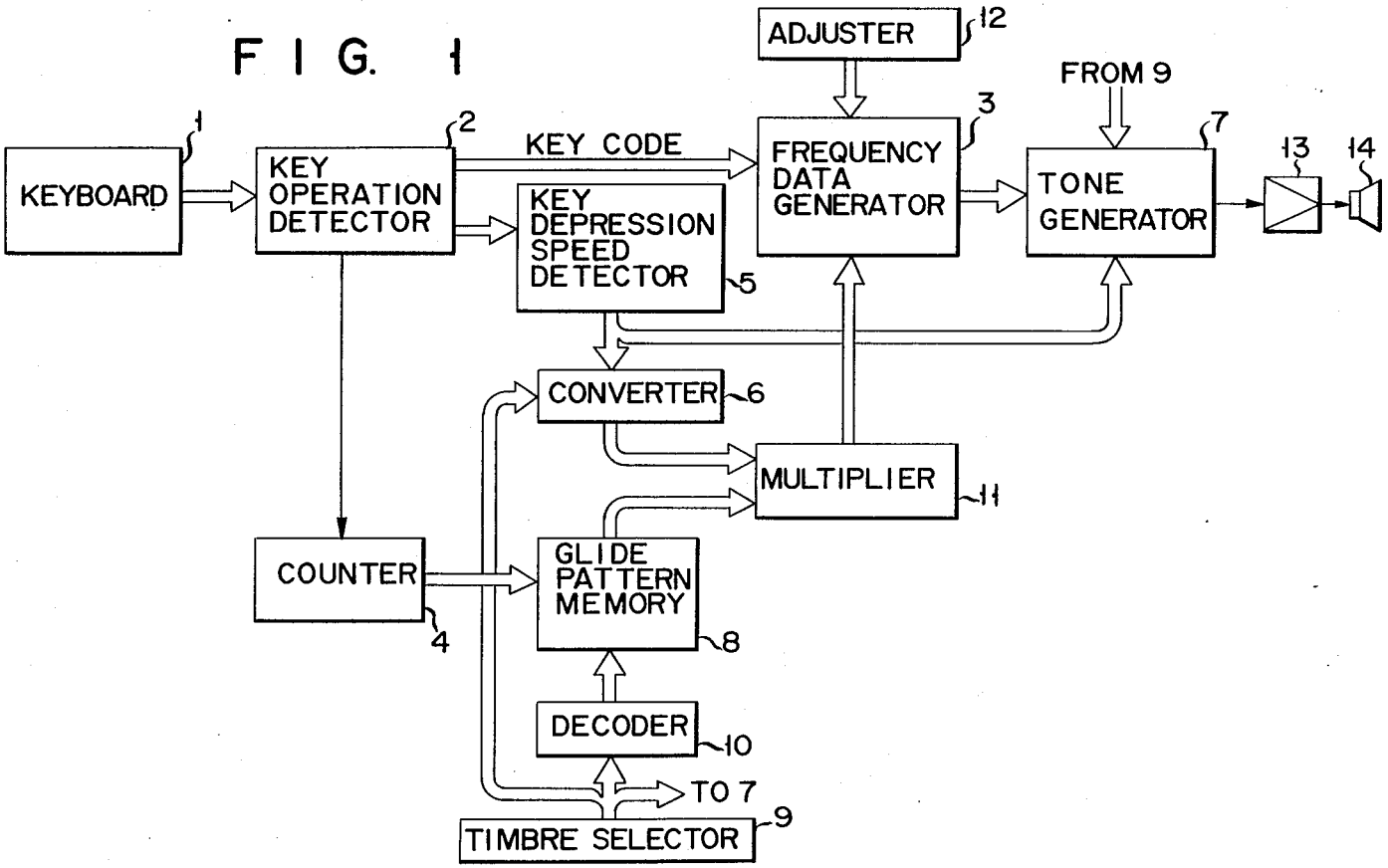
FIG. 1 is a block diagram showing an embodiment of the electronic musical instrument according to the invention.

FIG. 1 shows the first embodiment of the electronic musical instrument according to the invention.

The electronic musical instrument comprises a keyboard 1, a key operation detector 2, a frequency data generator 3, a counter 4 for a glide function, a key depression speed detector 5, a converter 6, a tone generator 7, a glide pattern memory 8, a timbre selector 9, a decoder 10, a multiplier 11, a sensitivity adjuster 12, an amplifier 13 and a loudspeaker 14.

The keyboard 1 has a plurality of keys and a plurality of key switches which are operative in response to the operation of the individual keys. More specifically, two, i.e., first and second, key switches are provided for each key on the keyboard 1. When each key is depressed and reaches a first predetermined depth, the associated first key switch is turned on. When the key is further depressed and reaches a second predetermined depth, the associated second key switch is turned on. The state when the second key switch is "on" is a key-on state of the corresponding key. When the key depression force is released, the key is returned to the initial state. At this time, the second and first key switches are turned off in succession in the mentioned order. The state when both the first and second key switches are "off" is a key-off state of the corresponding key. The output singal from each key switch is fed to the key operation detector 2. The key operation detector 2 thus detects the key-on or key-off state of each key and provides a key code and a key-on signal or a key-off signal of each key. The key code is fed to the frequency data generator 3. The key-on signal is fed as a count start command to the counter 4 for the glide function. The output signals of the key switches of the individual keys are coupled through the key operation detector 2 to the key depression speed detector 5. The key depression speed detector 5 detects the key depression speed of a depressed key and feeds key depression data to the converter 6 and tone generator 7.

Figure 3:
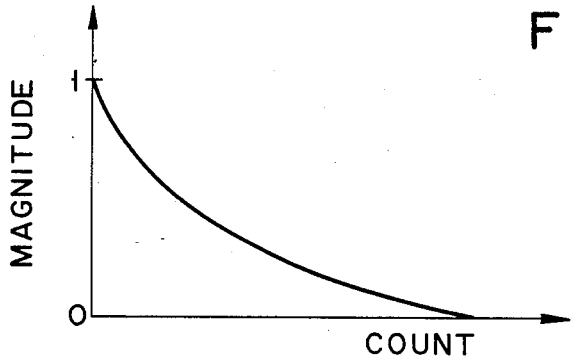

The output of the counter 4 is fed as address data for successively reading glide pattern data to the glide pattern memory 8. A plurality of different glide patterns are stored in the glide pattern memory 8. FIG. 3 shows an example of the glide pattern data stored. In this case, the magnitude of data decreases with increasing count of the glide function counter 4. FIG. 6 shows another example of the glide pattern data. In this case, the amplitude of the data increases with increasing count of the counter 4. The timbre selector 9 has a plurality of timbre selection switches. The different glide patterns stored in the glide pattern memory are selected by selective operation of the timbre selection switches. The output of the selected timbre selection switch is discriminated, i.e., decoded, by the decoder 10. The output of the decoder 10 is fed as address data to the glide pattern memory 8.

Figure 4:
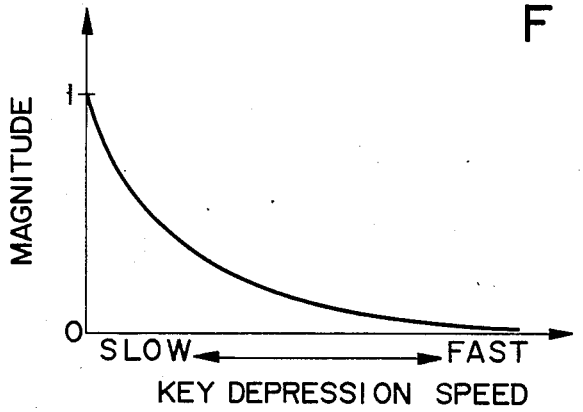
FIGS. 4 and 8 are graphs showing different examples of the conversion characteristic of a converter 6 in the embodiment of FIG. 1, i.e., the characteristic of the output of the converter 6 with respect to the key depression speed.
Figure 8:
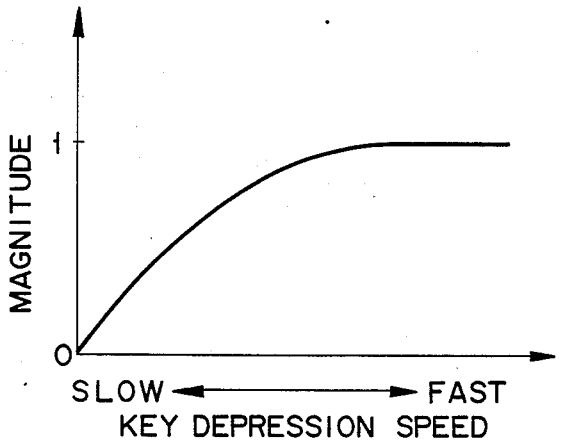

The timbre selection switch output of the timbre selector 9 is also fed to the converter 6. The converter 6 provides data in correspondence to the key depression speed data fed from the key depression speed detector 5 and the timbre selection switch output from the timbre selector 9. The data output of the converter 6 is fed to the multiplier 11. FIG. 4 shows an example of the data output of the converter 6. In this case, the amplitude of the data decreases with increasing key depression speed. FIG. 8 shows a different example of the data. In this case, the amplitude of the data increases with increasing key depression speed. The data output of the converter 6 is also controlled according to the output of the timbre selector 9. The output data of the converter 6 and the glide pattern data from the glide pattern memory 8 are fed to the multiplier 11. The multiplier 11 produces a product of the two input data, the product data being fed to the frequency data generator 3.

The product output of the multiplier 11 and the output of the sensitivity adjuster 12 are fed to the frequency data generator 3. The sensitivity adjuster 12 is provided for switching the sensitivity of the glide function. The frequency data generator 3 is controlled according to the operating state of the sensitivity adjuster 12, thus varying the glide width or range. It is thus possible to obtain an optimum glide effect according to the key depression speed through adjustment of the sensitivity adjuster 12.

The frequency data generator 3 generates tone frequency data corresponding to an operated key according to the key code fed form the key operation detector 2, glide data fed from the multiplier 11 and sensitivity data fed from the sensitivity adjuster 12. The generated tone frequency data is fed to the tone generator 7. The output of the timbre selector 9 is fed in addition to the tone frequency data to the tone generator 7. The tone generator 7 generates a tone signal, in which the timbre and glide are varied according to the respective input data. The tone signal provided from the tone generator 7 is fed through the amplifier 13 to the loudspeaker 14 to be sounded as a musical tone.

Figure 2:
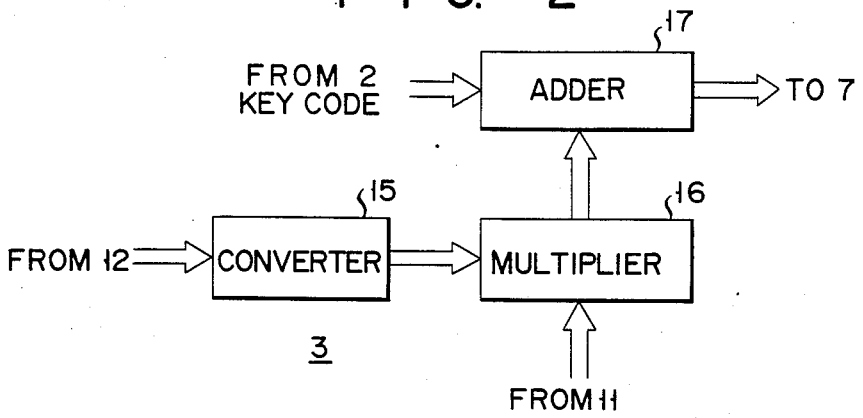
FIG. 2 is a block diagram showing the detailed construction of a frequency data generator 3 in the embodiment of FIG. 1.

FIG. 2 shows the detailed structure of the frequency data generator 3 as shown in FIG. 1.

The output of the sensitivity adjuster 12 is fed to a converter 15 for conversion to data corresponding to the extent of change in the output of the sensitivity adjuster 12. The converted data is provided as the output of the converter 15. The output data of the converter 15 is multiplied by the output data of the multiplier 11 in a multiplier 16. The product data from the multiplier 16 is fed to an adder 17. To the adder 17 is also fed the key code output of the key operation detector 2. The adder 17 adds the two inputs, i.e., the data from the multiplier 16 and key code data from the key operation detector 2. The key code data directly corresponds to the tone frequency of the operated key. The sum data of the adder 17 is fed as the frequency data to the tone generator 7.

The operation of the first embodiment will now be described with reference to FIGS. 3 to 5.

When a timbre selection switch in the timbre selector 9 is selectively operated, corresponding glide pattern data, for instance the one shown in FIG. 3, is selected through the decoder 10. When a key is depressed, the selected glide pattern data is progressively read out from the glide pattern memory 8 from the key-on instant to be fed to the multiplier 11.

Data corresponding to the timbre selection switch output of the timbre selection 9 and the key depression data from the key depression detector 5, is fed from the converter 6 to the multiplier 11. The data provided from the converter 6 is obtained from the conversion characteristic as shown in FIG. 4, for instance, according to the key depression speed.

The sensitivity adjuster is set to an optimum position according to the key depression force.

When a key on the keyboard 1 is strongly struck by the performer, the key code corresponding to the depressed key is fed from the key operation detector 2 to the frequency data generator 3 at the time of the key depression. At the same time, a key-on signal is fed from the key operation detector to the counter 4 to start the same. The glide pattern memory 8 is accessed according to the output of the counter 4.

Since the key is strongly struck in this case, the key depression speed is high. Consequently, key depression data having a comparatively large value is fed from the key depression speed detector 5 to the converter 6 and tone generator 7. Therefore, data of a small value is fed from the converter 6 to the multiplier 11. Further, data as shown in FIG. 3, which is maximum at the time of the key depression and is gradually decreasing, is fed from the glide pattern memory 8 to the multiplier 11. The multiplier 11 feeds the product of the two input data to the multiplier 16 in the frequency data generator 3. To the multiplier 16 is also fed the data from the converter 15. The multiplier 16 feeds the product of the two input data to the adder 17. The adder 17 adds the product data of the multiplier 16 and the key code data and feeds the sum data to the tone generator 7. To the tone generator 7 is also fed the timbre selection switch data of the timbre selection 9. The tone generator 7 thus generates a tone signal, which represents a tone of the timbre selected by the timbre selector 9 and has a glide effect as shown by curve C1 shown in FIG. 5, with the frequency being higher by a comparatively small amount than the proper tone frequency corresponding to the depressed key immediately after the key depression, and gradually approaching and reaching the proper tone frequency in a comparatively short period of time. The tone signal from the tone generator 7 is fed to the amplifier 13, and a tone corresponding to the tone signal is sounded from the loudspeaker 14.

When a key is struck weakly i.e., at a low depression speed, in the same preset states of the timbre selector 9 or sensitivity adjuster 12 as described above, a tone is sounded from the loudspeaker 14 with a glide effect as shown by curve C2 in FIG. 5, with the frequency being higher by a comparatively great amount (i.e., greater than in the case when the key is strongly struck) than the proper tone frequency corresponding to the depressed key immediately after the key depression, and gradually approaching and reaching the proper tone frequency in a comparatively long period time (compared to the case when the key is struck strongly).

The second embodiment of the invention will now be described in connection with a case when a different timbre selection switch of the timbre selector 9 from that described above, is selected.

With the selection of a different timbre selection switch from that described above, data as shown in FIG. 6 is read out from the glide pattern memory 8. The characteristic of the output of the converter 6, i.e., the control characteristic corresponding to the key depression speed, is as shown in FIG. 4, which is the same as in the case of the first embodiment.

In this case, when a key is depressed quickly, a tone is sounded from the loudspeaker 14 with a glide effect as shown in curve C3 in FIG. 7, with the frequency being lower by a comparatively small amount than the proper tone frequency corresponding to the depressed key immediately after the key depression, and gradually approximately and reaching the proper tone frequency in a comparatively short period of time.

On the other hand, when the key is depressed slowly, a tone is sounded from the loudspeaker 14 with a glide effect as shown in curve C4 in FIG. 7, with the frequency being lower by a comparatively great amount (i.e., greater than in the case when the key is strongly struck) than the proper tone frequency corresponding to the depressed key immediately after the key depression, and gradually approaching and reaching the proper tone frequency in a comparatively long period of time (compared to the case when the key is struck strongly).

A third embodiment of the electronic musical instrument according to the invention will now be described.

When the selection of a different timbre selection switch from those in the case of the first and second embodiments, the characteristic of the output of the converter 6, i.e., the control characteristic corresponding to the key depression speed, is set to a characteristic as shown in FIG. 8, in which the amplitude of data increases with increasing key depression speed. Glide pattern data as shown in FIG. 3, which is the same as in the case of the first embodiment, is progressively read out from the glide pattern memory 8.

Figure 9:
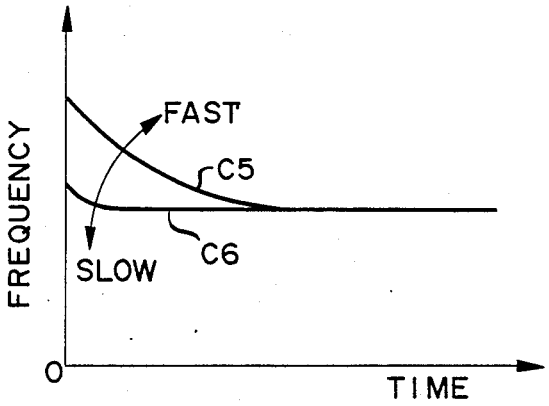

In this case, when a key is depressed quickly, a tone is sounded from the loudspeaker 14 with a glide effect as shown in curve C5 in FIG. 9, with the frequency being higher by a comparatively great amount than the proper tone frequency corresponding to the depressed key immediately after the key depression, and gradually approaches and reaches the proper tone frequency in a comparatively long period of time.

On the other hand, when a key is depressed slowly, a tone is sounded from a loudspeaker 14 with a glide effect as shown in curve C6 in FIG. 9, with the frequency being higher by a comparatively small amount (i.e., smaller than in the case when the key is strongly struck) than the proper tone frequency corresponding to the depressed key immediately after the key depression, and approaches and reaches the proper tone frequency in a comparatively short period of time (compared to the case when the key is struck strongly).

In the above embodiments, the frequency difference between the initial frequency of the signal and the frequency corresponding to the proper pitch of the musical tone, and the glide period which elapses until the frequency of a tone signal falls or rises to the value corresponding to the proper pitch of the tone, are both varied according to the key depression speed. However, similar effects may be obtained by varying either the glide period or the frequency difference.

Further, the key operation speed may be detected with other means than described above in order to detect the force with which the key is struck. Also, the key operation force may be detected by providing a piezoelectric element for each key.

What is claimed is:

1. An electronic musical instrument, comprising:

a keyboard including a plurality of keys each actuatable with a desired speed;

key operation detecting means for detecting operation of said keys on said keyboard;

key depression state detecting means for detecting the speed with which a key on said keyboard is actuated and producing corresponding output data;

glide pattern generating means for generating glide pattern data for determining glide pattern for tones to be generated in response to operation of said keys;

glide pattern data altering means for altering glide pattern data obtained from said glide pattern generating means according to the output data from said key depression state detecting means; and tone generating means for generating a tone with a desired glide effect in response to the altered glide pattern data from said glide pattern data altering means when a key operation is detected by said key operation detecting means.

2. The electronic musical instrument according to claim 1, wherein said glide pattern generating means includes a memory for storing data of a plurality of glide patterns, and selecting means for selecting data of one of said plurality of glide patterns stored in said memory.

3. The electronic musical instrument according to claim 1, wherein said glide pattern generating means comprises means for generating glide pattern data corresponding to a frequency change, in which the frequency is highest at the time of a key operation and gradually decreases toward a tone frequency corresponding to the operated key.

4. The electronic musical instrument according to claim 1, wherein said glide pattern generating means comprises means for generating glide pattern data corresponding to a frequency change, in which the frequency is lowest at the time of a key operation and gradually increases toward a tone frequency corresponding to the operated key.

5. The electronic musical instrument according to claim 1, wherein said glide pattern data altering means alters glide pattern data so that the greater the speed of actuation of a key, a lesser glide effect is obtained.

6. The electronic musical instrument according to claim 1, wherein said glide pattern data altering means alters glide pattern data so that the greater the speed of actuation of a key, a greater glide effect is obtained.

* * * * *